US007305913B2

(12) United States Patent
Schradi

(10) Patent No.: US 7,305,913 B2
(45) Date of Patent: Dec. 11, 2007

(54) HYDRAULIC UNIT

(75) Inventor: Peter Schradi, Nuremberg (DE)

(73) Assignee: Schuler Automation GmbH & Co. KG, Hessdorf (DE)

( * ) Notice: Subject to any disclaimer, the term of this patent is extended or adjusted under 35 U.S.C. 154(b) by 239 days.

(21) Appl. No.: 11/202,157

(22) Filed: Aug. 12, 2005

(65) Prior Publication Data

US 2006/0032368 A1 Feb. 16, 2006

(30) Foreign Application Priority Data

Aug. 14, 2004 (DE) ..... 10 2004 039 483

(51) Int. Cl.
*F15B 15/22* (2006.01)
*F15B 11/13* (2006.01)

(52) U.S. Cl. ..... 91/38; 91/445

(58) Field of Classification Search ..... 91/38, 91/393, 396, 181, 405, 469, 445, 447
See application file for complete search history.

(56) References Cited

U.S. PATENT DOCUMENTS 2,664,106 A * 12/1953 Livers ..... 91/38

FOREIGN PATENT DOCUMENTS

DE 4428081 A1 * 2/1996
JP 01083928 A * 3/1989

* cited by examiner

*Primary Examiner*—Thomas E. Lazo
(74) *Attorney, Agent, or Firm*—Manabu Kanesaka

(57) ABSTRACT

An hydraulic unit includes a hydraulic cylinder, and a piston retained in the hydraulic cylinder, wherein the piston can be moved from a first end position located at one end of the hydraulic cylinder to a second end position located at the opposite other end position of the hydraulic cylinder. The hydraulic cylinder is hydraulically connected with a delay unit which is equipped with an auxiliary cylinder containing an auxiliary piston, with which a movement of the piston can be delayed in a middle section located between the first and the second end position. The auxiliary cylinder has a first and a second opening for incoming and outgoing hydraulic oil. In order to precisely set an attenuation point, a throttle valve provided on the auxiliary cylinder or piston be connected in the flow path.

10 Claims, 3 Drawing Sheets

HYDRAULIC UNIT

RELATED APPLICATIONS

The present application is based on, and claims priority from, German Application Number 10 2004 039 483.0, filed Aug. 14, 2004, the disclosure of which is hereby incorporated by reference herein in its entirety.

BACKGROUND OF THE INVENTION

The invention relates to a hydraulic unit.

Such a hydraulic unit is known from DD 46 600.

The known hydraulic unit has the disadvantage that a delayed movement of a piston in a section of the hydraulic cylinder located between the first and second end position is not possible for a precisely specified position.

Such hydraulic units are widely known in accordance with the state of technology. For example, they are used to generate an opening and closing movement of a gripper installed on a transfer. To attenuate the opening and closing movement of the gripper at the end of the particular path of motion, one usually uses hydraulic cylinders with a so-called end position attenuation. With this, the hydraulic cylinder and a piston installed therein work together on the ends of the hydraulic cylinder with a suitable geometrical embodiment so that the hydraulic oil is forced through a narrowed cross section when the end position is reached and the movement of the hydraulic cylinder is thus delayed or attenuated in the vicinity of the end position.

In particular, hydraulically operated grippers are usually constructed so that the end positions of the hydraulic cylinder correspond to a maximum opening or closing position of the gripper arms of the gripper. In the maximum closing position, the gripper arms are usually resting flat on each other. However, when a work piece is gripped with the gripper arms, this gripping position usually corresponds to a middle position of the piston contained in the hydraulic cylinder. The movement from the maximum opening position to the gripping position takes place without any attenuation whatsoever.

Due to this, undesired pressure shocks in hydraulic unit occur when the work piece is gripped.

Object of the invention is to eliminate the disadvantages in accordance with the state of technology. In particular, a hydraulic unit is to be specified which is as simple and inexpensive to manufacture as possible and which permits an attenuated movement of the piston in a middle section of the hydraulic cylinder located between the first and the second end position. In particular, the movement should be able to be delayed with a precisely specified position in a section located between the first and second end position. In accordance with a further goal of the invention, the hydraulic unit is be able to be operated to the extent possible with conventional hydraulic cylinders.

SUMMARY OF THE INVENTION

This object is solved with the features of the invention.

According to the invention, it is provided that a throttle valve installed on an auxiliary cylinder or auxiliary piston is connected in the path of flow. —With the delay unit suggested by the invention, it is possible to vary as desired a delay point for the start of the delayed movement of the piston.

The delay point is determined with the delay unit. Its position depends on the cubic space displaced by the movement of the piston. The delay point and the first and/or second end position can be specified precisely. In particular with a hydraulic gripper, this makes it possible to attenuate the movement in the gripping position. Undesired pressure shocks while the work pieces are being gripped are avoided. This increases the lifespan of the hydraulic unit and the grippers. Apart from this, the hydraulic unit can be operated with a higher pressure and with an increased stroke speed.

A "middle section" of the hydraulic cylinder is understood to mean a section which is located outside the attenuation areas in the end positions of the piston. An attenuation in the area of the end positions usually covers less than 10% of the total path of motion of the piston from one end position to the other. A flow path is understood to mean a path via which hydraulic oil can flow.

In accordance with an advantageous embodiment, the delay unit can be designed as a separate installation unit. This makes it possible to combine conventional hydraulic cylinders, in particular hydraulic slave cylinders, with the delay unit without great cost or effort. No constructive changes to the hydraulic cylinders are necessary. For example, the delay unit can be installed in a down current line leading to a hydraulic slave cylinder. For example, conventional hydraulic cylinders can also be used with end position attenuation. In this case, the hydraulic unit is equipped with an additional delay point for use of an attenuated movement between the two end positions in addition to the end position attenuation.

In accordance with an embodiment of the invention, a maximum stroke position of the auxiliary piston can be set. With this, the delay point can be set as desired along the path of movement of the piston. For the setting, an adjustment screw which can be activated manually or via an electro-motor can be provided, for example, with which screw a stop of the auxiliary piston can be changed. To the extent that the maximum stroke of the auxiliary piston can be set with an electro-motor, this can be controlled with a controller. In this way, the maximum stroke can be set, for example, corresponding to specified stored values. In particular, with a gripper equipped with the hydraulic unit provided by the invention, its gripping movement can be adjusted quickly and simply to different work piece dimensions.

The throttle valve can open when the maximum stroke position of the auxiliary piston is reached. With this, the delay of the movement of the piston can be determined by the shut-off cross section of the throttle valve. It has been shown to be particularly advantageous when the shut-off cross section can be set. A delay unit with the aforementioned features can be made simply and inexpensively. When the throttle valve opens, the attenuated movement begins. The attenuation is determined by the hydraulic cross section of the opened throttle valve. It is useful that the shut-off cross section and thus the delay or attenuation of the movement of the piston can be set. —This can thus be provided by a universally-designed delay unit as a separate installation unit with which a plurality of conventional hydraulic cylinders can be retrofitted with regard to an attenuated movement in a middle section located between the end positions.

According to a further embodiment, the delay unit has a bypass with a one-way valve connected therein. This makes it possible to push back the piston quickly to its end position. Using a gripper equipped with the hydraulic unit provided by the invention, the stroke speed with which the work pieces are gripped can be increased.

It is useful that a spring be provided in the auxiliary cylinder with which spring the auxiliary piston is forced to the starting position. The piston has no stroke in the starting position. The provision of a spring makes it simple to return the piston to the starting position and is not prone to malfunction.

According to a further embodiment, it is provided that the delay unit be connected in a first or second line connected with the hydraulic cylinder. The suggested construction is simple. In particular, it is not necessary to connect the delay unit in a separate bypass on the hydraulic cylinder.

In further accordance with the invention, a gripper is equipped with the hydraulic unit provided by the invention. In particular, this can be a gripper which is provided on a workpiece transfer. For example, such a work piece transfer is known from EP 0 633 077 A1, the disclosed contents of which are herewith included.

DETAILED DESCRIPTION OF THE EMBODIMENTS

Figure 1:
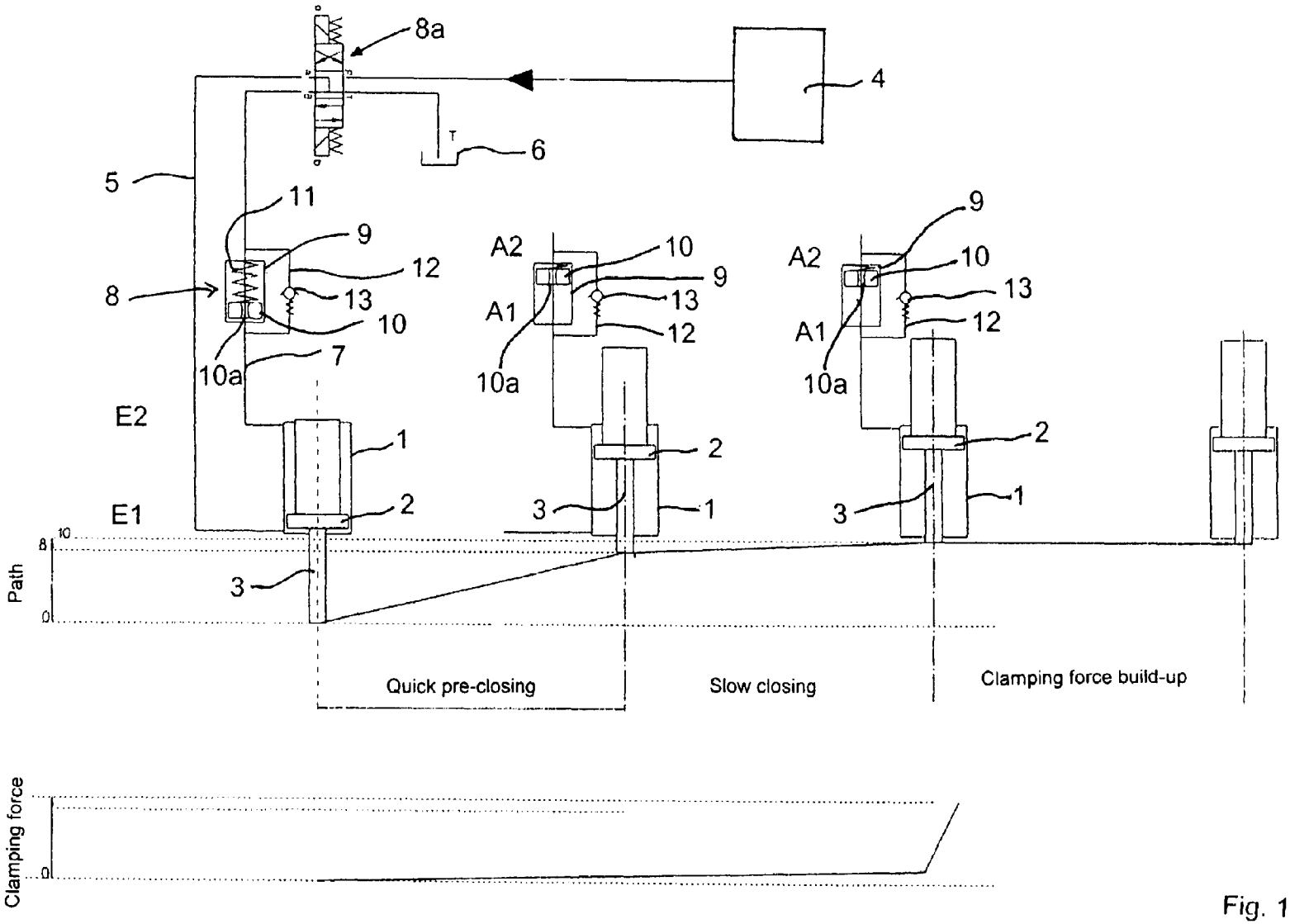
FIG. 1 is a schematic presentation of the function of the hydraulic unit provided by the invention.

In FIG. 1, a hydraulic cylinder 1 contains a piston 2 with a piston rod 3. A source of pressure 4 is hydraulically connected via a first line 5 with the one end E1 of the hydraulic cylinder 1. The other end E2 of the hydraulic cylinder 1 has a second line 7 connected with a fluid reservoir 6. The pressure source 4 can form a construction unit together with the fluid reservoir 6. It is useful that the liquid used here is oil, in particular hydraulic oil. A delay unit 8 is connected in the second line 7. The pressure source 4 and the liquid reservoir 6 can be circuited via a switch-over unit 8*a* to either the first 5 or the second line 7. This means that either the first 5 or the second line 7 can be provided with pressure and the other line 5 or 7 does not have pressure.

The delay unit 8 is equipped with an auxiliary cylinder 9 and an auxiliary piston 10 contained therein. The auxiliary piston 10 is provided with a throttle valve 10*a*. A spring 11 forces the auxiliary piston 10 from a maximum stroke position A2 to a starting position A1. The delay unit 8 is provided with a bypass 12 in which a one-way valve 13 is connected so that a flow of liquid coming from the hydraulic cylinder 1 can flow off exclusively through the delay unit 8 to the liquid reservoir 6.

FIG. 1 shows various positions of the piston 2 in the hydraulic cylinder 1. Furthermore, the path of the piston 2 is shown in dependence on the time and the clamping force of a gripper operated with the hydraulic unit in dependence on the time.

In the following the function of the hydraulic unit provided by the invention will be described based on FIG. 1 using the positions of piston 2 shown from left to right. In the left-hand presentation, the piston 2 is located in a first end position E1. A cubic space created in the hydraulic cylinder 1 between the piston 2 and the second end position E2 is filled with hydraulic oil. Using the source of pressure 4, hydraulic oil is fed to the hydraulic cylinder 1 under pressure via the incoming line 5. This presses the piston 2 in the direction of the second end position E2. The oil cubic space displaced by the second line 7 is pressed into auxiliary cylinder 9 and moves the auxiliary piston 10 from the starting position A1 to the maximum stroke position A2. During this, the spring 11 is completely compressed.

As soon as the auxiliary piston 10 has reached the maximum stroke position A2, further hydraulic oil fed to the auxiliary cylinder 9 can only still flow off via the throttle valve 10*a*. This delays or attenuates the movement of the piston 2.

Figure 2:
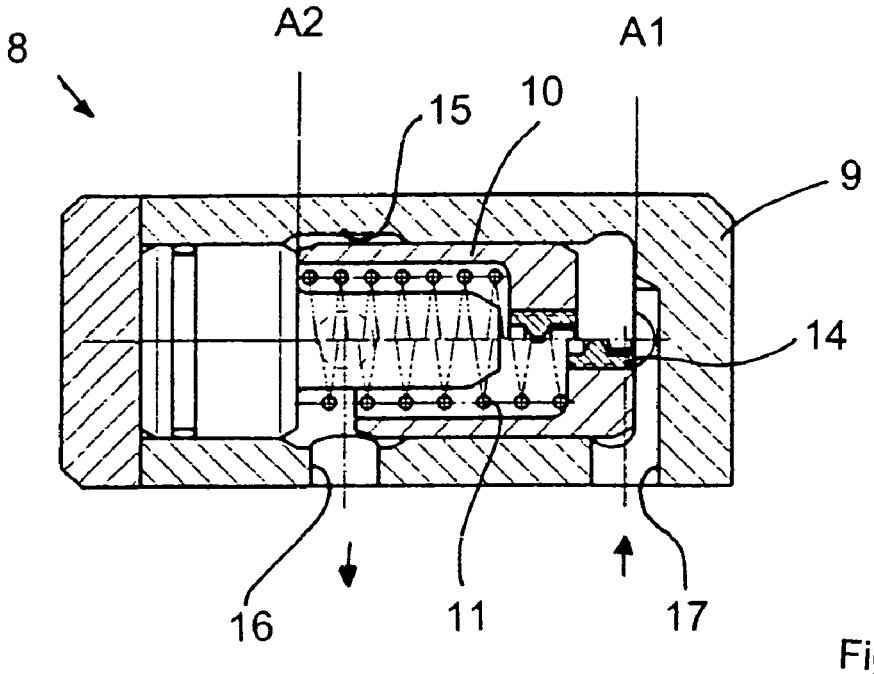
FIG. 2 is a cross section view of a first delay unit.

The delay unit particularly including the auxiliary cylinder 9 and the auxiliary piston 10 as well as the throttle valve 10*a* is connected in FIG. 2 on the second line 7. It is naturally also possible to connect the delay unit on the first line 5. It is also possible to connect such delay units both on the first 5 and the second line 7.

Only for explanation purposes, FIG. 1 also shows the situation in which the piston 2 is in the second end position E2. In this case, the gripper is closed without a work piece W or a moulded piece having been gripped.

To open a gripper operated with the hydraulic unit, the direction of flow of the hydraulic oil is reversed: The source of pressure 4 is switched to the second line 7 to provide the necessary pressure. Hydraulic oil is now fed under pressure through the second line 7 to the second end E2 of the hydraulic cylinder 1. During this, the hydraulic oil reaches in particular via bypass 12 and the opened one-way valve 13 for this direction of flow. The first line 5 is switched to the liquid reservoir 6 and thus has no pressure. This moves the piston 2 from the second end position E2 back in the direction of the first end position E1. The described movement can be repeated by another switch-over of the pressure source 4 to the first line 5 as well as of the liquid reservoir 6 to the second line 7.

To open the gripper, the source of pressure 4 is switched to the second line 7 and the liquid reservoir 6 is switched to the first line 5. At this moment—as shown in FIG. 1 in the next to the last figure—the gripper is without pressure.

FIG. 2 shows a first example to describe the invention of a delay unit 8. The auxiliary cylinder 9 contains the auxiliary piston 10 in starting position A1. The throttle valve 10*a* is shown here in the form of a jet 14 provided in the piston floor. A ring passage 15 is provided in the area of the maximum stroke position A2, which passage is connected with a first opening 16. A second opening is designated with the reference designation 17.

With the delay unit 8 shown in FIG. 2, the auxiliary piston 10 is first pushed against the force of the spring 11 into the maximum stroke position A2 through the hydraulic oil fed through the second opening 17. After this, additional incoming hydraulic oil can still only be led off via the jet 14 and the ring passage 15 via the first opening 16. This can be used to attenuate a movement of piston 2 in hydraulic cylinder 1. It is naturally also possible to otherwise equip the throttle valve 10*a*. The throttle valve can also be provided on the auxiliary cylinder 9. Furthermore, it is possible that components of the throttle valve are provided both on the auxiliary piston 10 and on the auxiliary cylinder 9 and that both work together in such a way that the aforementioned attenuated movement is achieved.

Figure 3:
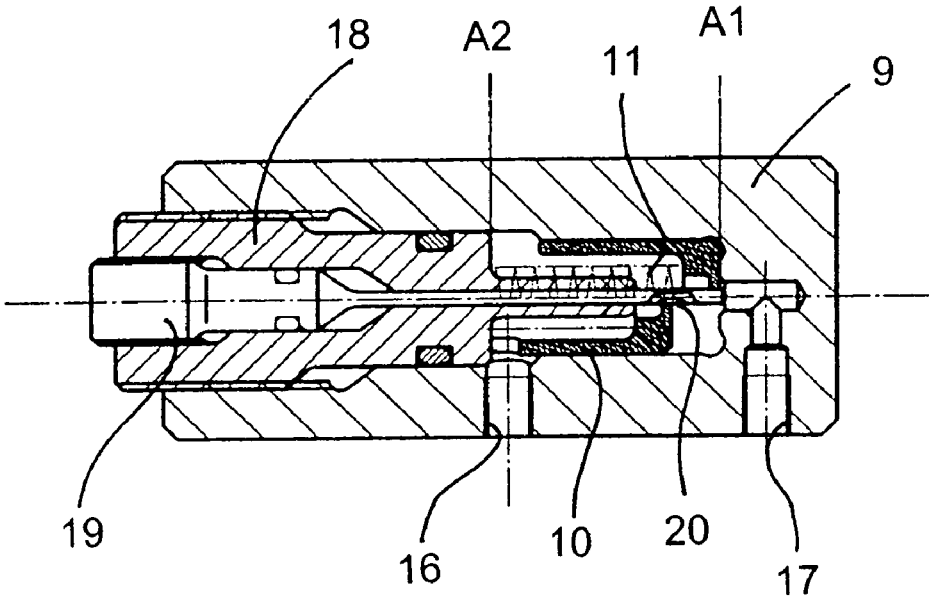
FIG. 3 is a cross section view of a second delay unit.

FIG. 3 shows a second example describing the invention of a delay unit 8. With this, the auxiliary cylinder 9 contains an adjustable stop 18 with which the maximum stroke position A2 can be set. Stop 18 contains a jet needle 19 which can be adjusted axially relative thereto, which needle has a recess 20 in the vicinity of its end. The second delay unit 8 which is shown is particularly universal. With this, both the maximum stroke position A2 and the hydraulic penetration cross section of the throttle valve 10*a* can be set.

When the hydraulic oil which is under pressure is fed through the second opening 17, the auxiliary piston 10 is pressed against the force of the spring 11 up to the maximum stroke position A2. This causes the throttle valve 10*a* formed from the recess 20 to open. The hydraulic oil flows through the throttle valve 10*a* and flows off via the first opening 16. A hydraulic cross section of the throttle valve 20 and thus the delay of the movement can be changed by adjusting the jet needle 19 relative to the stop 18.

Figure 4C:
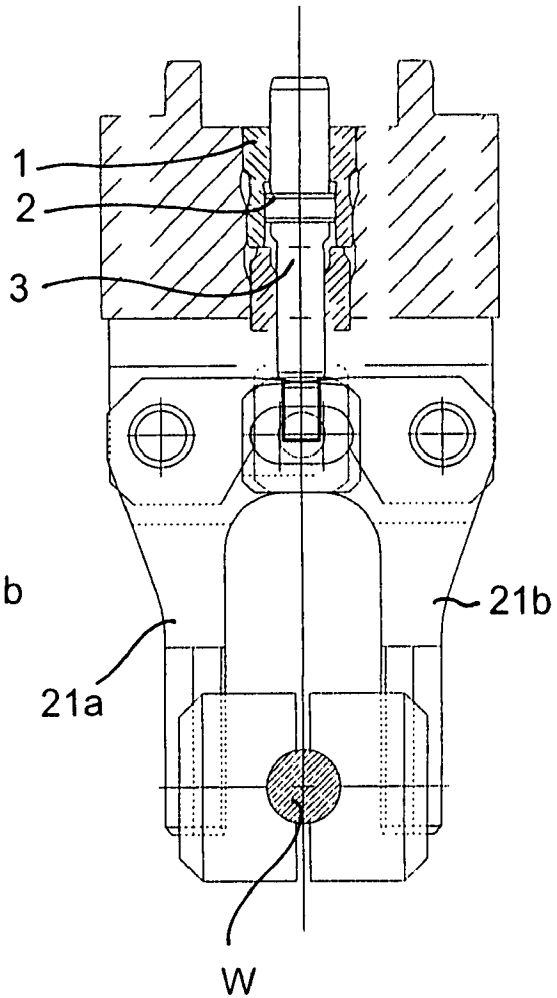
FIG. 4*a* is a sectional view of a gripper with gripping arms located in the opening position.
FIG. 4*b* is the gripper according to FIG. 4*a* with the gripping arms in closed position without work piece, and FIG. 4*c* the gripper according to FIG. 4*b* with gripping arms in closed position with work piece.
Figure 4B:
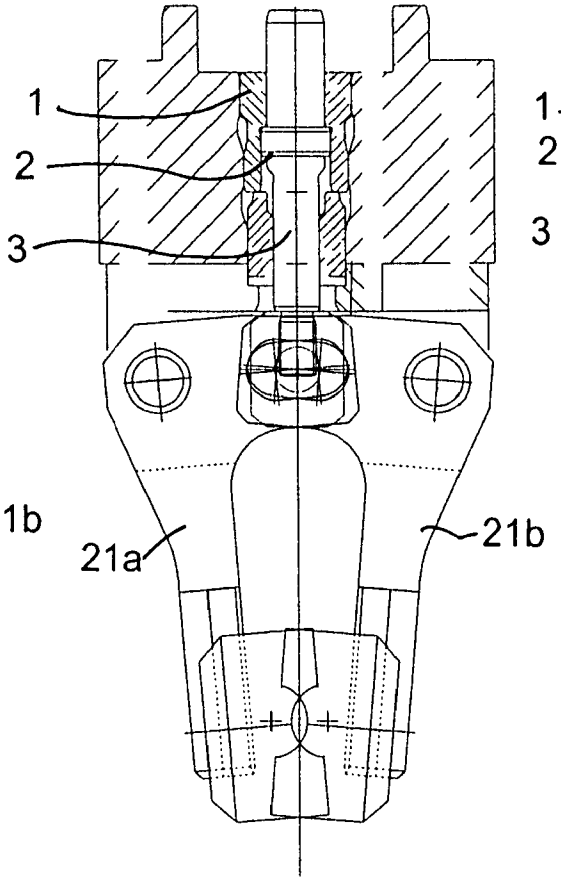
Figure 4A:
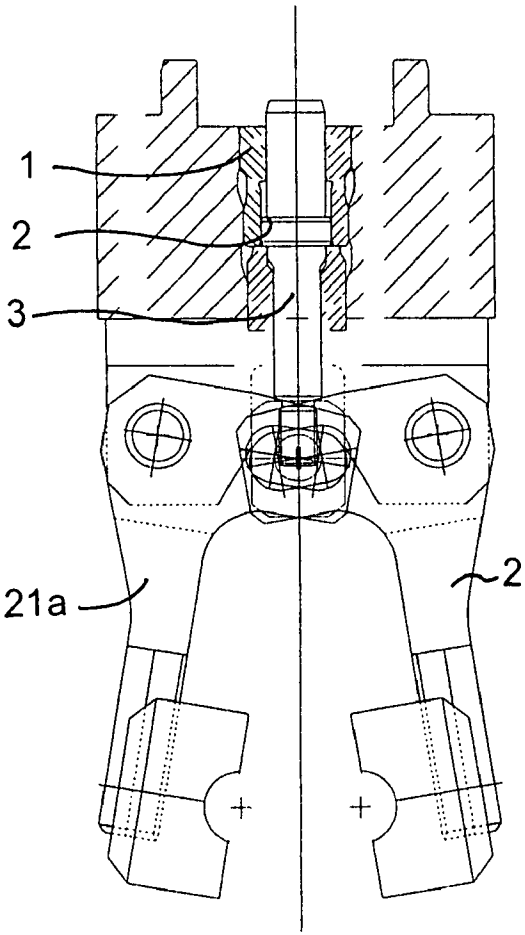

FIG. 4*a* to 4*c* show a gripper with two gripping arms 21*a* and 21*b*. The gripper is provided with a hydraulic cylinder 1 which contains the piston 2 with the piston rod 3 extending away. The movement of the grippers 21*a*, 21*b* is controlled via the piston rod 3. FIG. 4*a* shows the gripper in the opened position and FIG. 4*b* shows the gripper in the closed position without work pieces W. FIG. 4*c* shows the gripper, wherein the gripper arms 21*a*, 21*b* are gripping a work piece W here. During this, the piston 2 is located in a middle position located between the end position E1, E2. A movement of the gripper arms 21*a*, 21*b* to the gripping position shown in FIG. 4*c* can be attenuated by the delay unit 8 shown in FIG. 1 to 3.

REFERENCE DESIGNATION LIST

1 Hydraulic cylinder
2 Piston
3 Piston rod
4 Pressure source
5 First line
6 Liquid reservoir
7 Second line
8 Delay unit
8*a* Switch-over unit
9 Auxiliary cylinder
10 Auxiliary piston
10*a* Throttle valve
11 Spring
12 Bypass
13 One-way valve
14 Jet
15 Ring passage
16 First opening
17 Second opening
18 Stop
19 Jet needle
20 Recess
21*a*, 21*b* Gripper arms
A1 Starting position
A2 Maximum stroke position
E1 First end position
E2 Second end position
W Work piece

The invention claimed is:

1. Hydraulic unit comprising:

a hydraulic cylinder, a piston contained in the hydraulic cylinder to be moved from a first end position located at one end of the hydraulic cylinder to a second end position located at the opposite other end position of the hydraulic cylinder, a delay unit hydraulically connected to the hydraulic cylinder so that a movement of the piston can be delayed in a middle section located between the first end position and the second end position, said delay unit comprising an auxiliary cylinder having a first and a second opening for incoming and outgoing hydraulic oil, an auxiliary piston movably retained in the auxiliary cylinder, and a spring urging the auxiliary piston from a maximum stroke position to a starting position, and a throttle valve provided on the auxiliary cylinder or auxiliary piston connected in the flow path for providing an attenuation movement of the piston.

2. Hydraulic unit as defined in claim 1, wherein the delay unit is designed as a separate installation unit.

3. Hydraulic unit as defined in claim 1, wherein the maximum stroke position of the auxiliary piston can be adjusted.

4. Hydraulic unit as defined in claim 1, wherein the delay of the movement of the piston is determined by a hydraulic cross section of the throttle valve.

5. Hydraulic unit as defined in claim 4, wherein the hydraulic cross section can be adjusted.

6. Hydraulic unit as defined in claim 4, wherein the delay unit has a bypass with a one-way valve connected therein.

7. Hydraulic unit as defined in claim 1, wherein the delay unit is installed in a first or second line connected with the hydraulic cylinder.

8. Gripper with the hydraulic unit as defined in claim 1.

9. Hydraulic unit comprising:

a hydraulic cylinder, a piston contained in the hydraulic cylinder to be moved from a first end position located at one end of the hydraulic cylinder to a second end position located at the opposite other end position of the hydraulic cylinder, a delay unit hydraulically connected to the hydraulic cylinder, and comprising an auxiliary cylinder having an auxiliary piston, with which a movement of the piston can be delayed in a middle section located between the first end position and the second end position, the auxiliary cylinder having a first and a second opening for incoming and outgoing hydraulic oil, and a throttle valve provided on the auxlliary cylinder or auxiliary piston connected in the flow path, wherein the throttle valve opens when the maximum stroke position of the auxiliary piston is reached.

10. Hydraulic unit as defined in claim 9, wherein a spring is provided in the auxiliary cylinder, with which the auxiliary piston is forced into a starting position.

* * * * *